US007665542B2

(12) United States Patent
Stockton

(10) Patent No.: US 7,665,542 B2
(45) Date of Patent: Feb. 23, 2010

(54) CORE BARREL CAPACITY GAUGE AND METHOD

(75) Inventor: Damian Jonathon Stockton, Perth (AU)

(73) Assignee: Coretrack Ltd., Perth, Western Australia (AU)

( * ) Notice: Subject to any disclaimer, the term of this patent is extended or adjusted under 35 U.S.C. 154(b) by 59 days.

(21) Appl. No.: 11/720,495

(22) PCT Filed: Dec. 2, 2005

(86) PCT No.: PCT/AU2005/001812

§ 371 (c)(1),
(2), (4) Date: May 30, 2007

(87) PCT Pub. No.: WO2006/058377

PCT Pub. Date: Jun. 8, 2006

(65) Prior Publication Data

US 2008/0156537 A1 Jul. 3, 2008

(30) Foreign Application Priority Data

Dec. 2, 2004 (AU) ..... 2004906893

(51) Int. Cl.
*E21B 25/16* (2006.01)

(52) U.S. Cl. ..... 175/44; 175/244; 175/249

(58) Field of Classification Search ..... 175/44, 175/244, 249

See application file for complete search history.

(56) References Cited

U.S. PATENT DOCUMENTS 3,986,555 A * 10/1976 Robertson ..... 175/246
6,006,844 A * 12/1999 Van Puymbroeck et al. ... 175/50
6,457,538 B1 * 10/2002 Pittard et al. ..... 175/46

FOREIGN PATENT DOCUMENTS

GB 2 243 173 A 10/1991
RU 2196871 1/2003

* cited by examiner

*Primary Examiner*—Jennifer H Gay
*Assistant Examiner*—Catherine Loikith
(74) *Attorney, Agent, or Firm*—Nixon & Vanderhye P.C.

(57) ABSTRACT

A core barrel capacity gauge for use on a core barrel assembly having a barrel for receiving a core sample. The core barrel capacity gauge includes a core sample marker located within the barrel such that the core sample marker rests against the top of the drilled core sample and a marker location sensor. The marker location sensor is arranged to detect the location of the core sample marker within the barrel.

20 Claims, 4 Drawing Sheets

CORE BARREL CAPACITY GAUGE AND METHOD

This application is the US national phase of international application PCT/AU2005/001812 filed 2 Dec. 2005 which designated the U.S. and claims benefit of Australian Application No. 2004906893 filed 2 Dec. 2004, the entire contents of both applications are hereby incorporated by reference.

FIELD OF THE INVENTION

The present invention relates to core barrel capacity gauge.

BACKGROUND OF THE INVENTION

When it is required to obtain a cross sectional sample of a particular geological formation, it is known to use a core barrel assembly in place of a standard drill bit.

The core barrel assembly utilizes a specialized core bit attached to a number of outer barrels that are interconnected to make up the desired length. The core bit drills downwardly and has a central opening such that the core bit cuts around a column of the formation that is to be the sample. An inner barrel is provided within the outer barrel for receiving the core sample. The inner barrel is provided with an adaptor at the lower end that allows the core to pass into the inner barrel but not to fall back out.

The process of obtaining a core sample generally commences by connecting the core barrel assembly to the standard drill pipe string and lowering it to the bottom of the hole. Fluid is pumped through the drill string into the core barrel assembly where it passes through the inner barrel and the cavity between the inner and outer barrels to flush them of debris. A diverter ball is dropped through the drill string before commencement of sampling to seal the opening to the inner barrel so that fluid pumped down the drill string is passed only through the cavity between inner and outer barrels and coring commences. During coring, the core bit is designed to drill around a vertical column of the sample such that the inner barrel passes downwardly around the sample. A known problem that can occur in such a situation is that if the core column is not sufficiently stable, it can collapse downwardly within the inner barrel. The collapsed core column can create additional friction on the inner surface of the inner barrel resulting in jamming of the core.

Observations of the drilling fluid pressure, the torque and the rate of penetration can provide some indication of whether this core collapse has occurred, however it is not possible to rule out the possibility that changes in these values are the result of some other event (such as a change in the formation). The driller is therefore forced to make a decision that could result in continuing drilling when the core is jammed or stopping drilling when the core is not jammed, both situations resulting in an expensive loss of time and effort.

The present invention attempts to overcome at least in part the aforementioned problem of detecting collapse of a core sample within a core barrel assembly.

SUMMARY OF THE INVENTION

In accordance with one aspect of the present invention there is provided a core barrel capacity gauge for use on a core barrel assembly having a barrel for receiving a core sample, wherein the core barrel capacity gauge includes a core sample marker located within the barrel such that the core sample marker rests against the top of the drilled core sample and a marker location sensor, the marker location sensor being arranged to detect the location of the core sample marker within the barrel.

BRIEF DESCRIPTION OF THE DRAWINGS

The present invention will now be described, by way of example, with reference to the accompanying drawings, in which.

DESCRIPTION OF THE INVENTION

Figure 1:
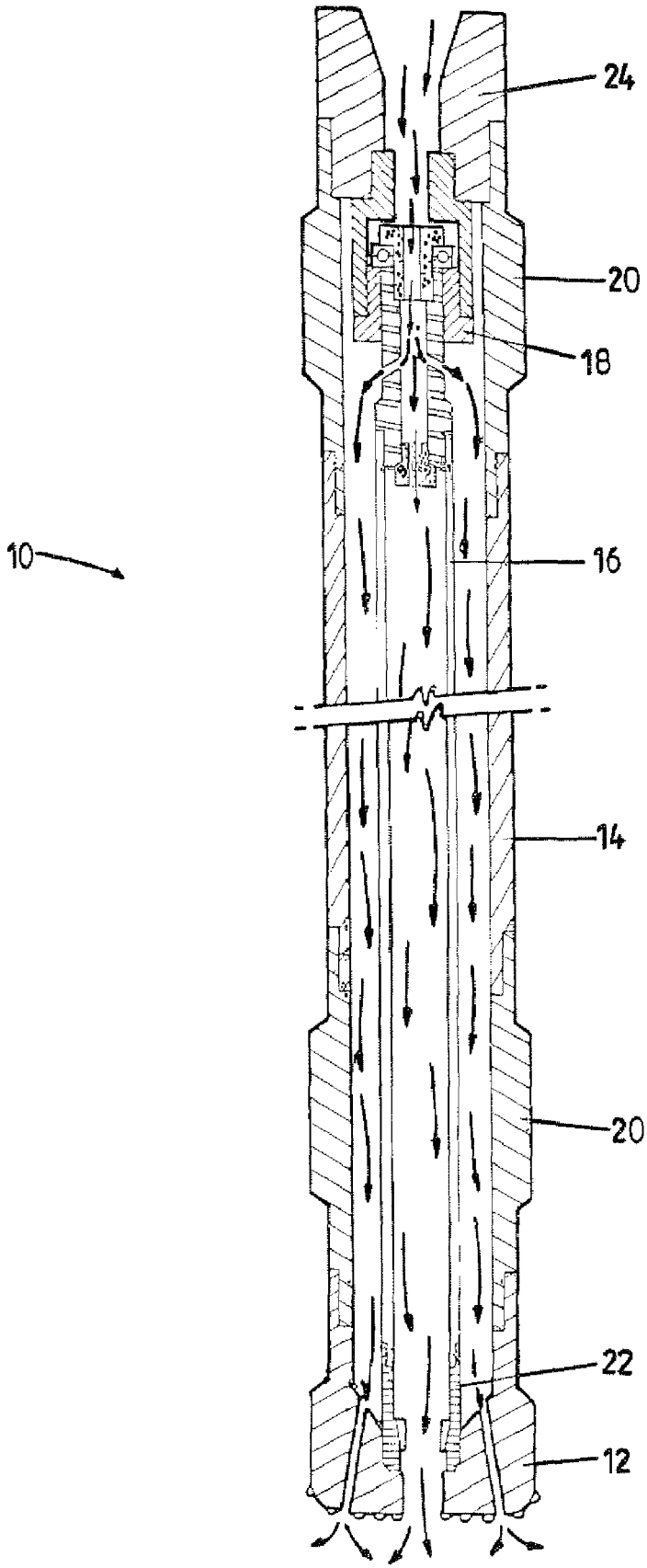
FIG. 1 Prior Art
FIG. 1 is a side cross sectional view of a core barrel assembly of known configuration.
Figure 2:
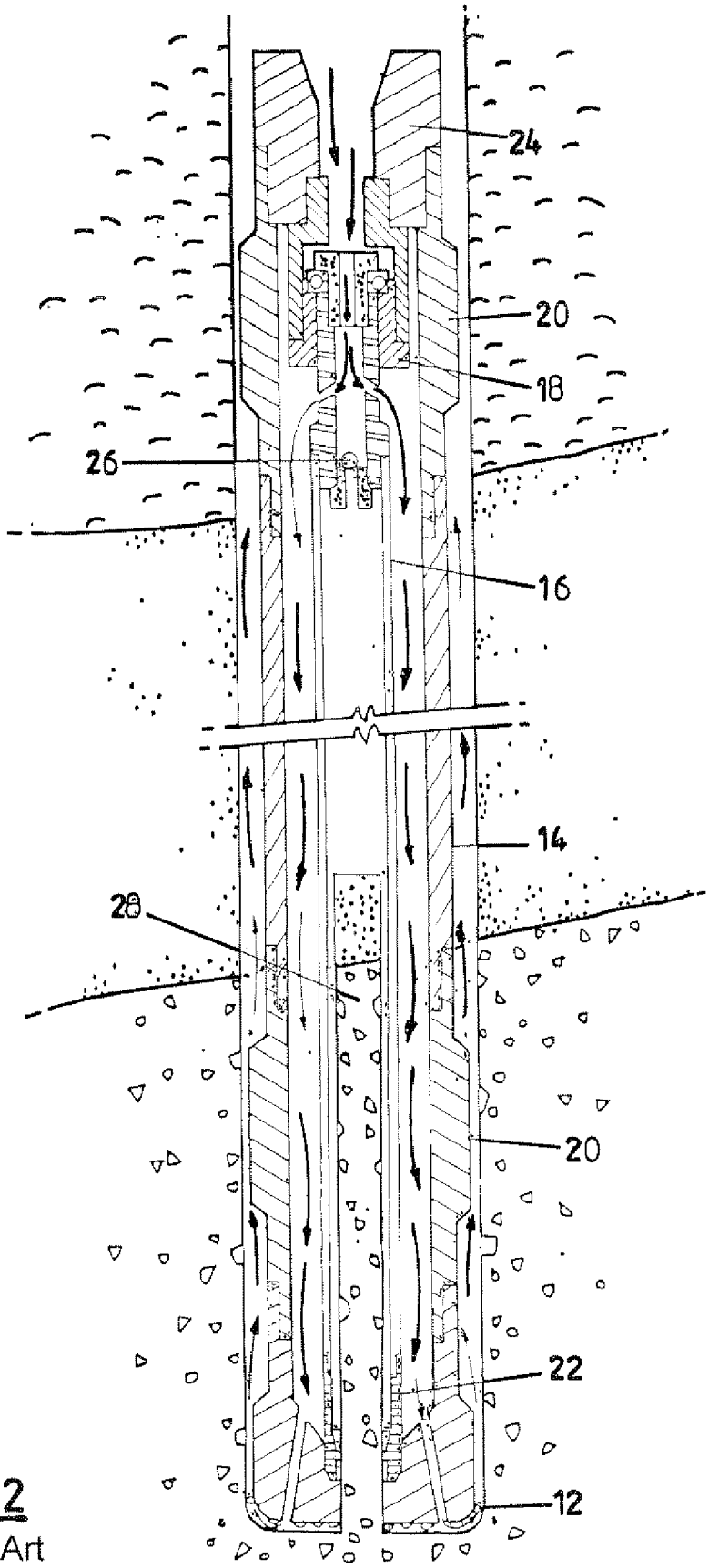
FIG. 2 Prior Art
FIG. 2 is a side cross sectional view of the core barrel assembly of FIG. 1 during the process of obtaining a core sample.
Figure 3:
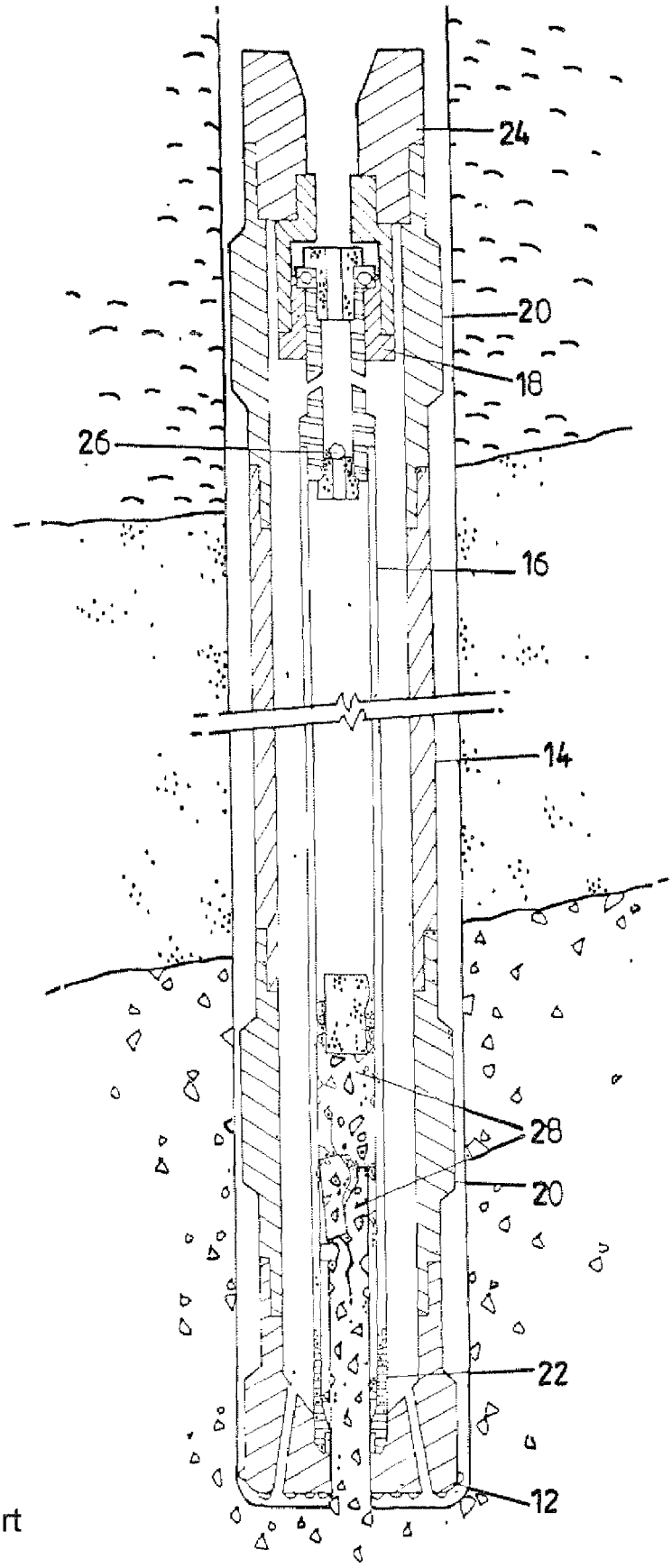
FIG. 3 Prior Art
FIG. 3 is a side cross sectional view of the core barrel assembly of FIG. 1 during the process of obtaining a core sample where the core sample has collapsed.

Referring to the FIGS. 1 to 3, there is shown a core assembly 10 on which the core barrel capacity gauge of the present invention may be used. The core barrel assembly 10 includes a core bit 12 attached to the lower end of one or more outer barrels 14. The outer barrels 14 are connected to a top adaptor 24 that includes a swivel assembly 18 onto which is attached an inner barrel 16 for receiving the core sample. Stabilisers 20 are provided between adjacent outer barrels 14. The inner barrel is provided with an adaptor 22 at the lower end that allows the core to pass into the inner barrel but not to fall back out.

FIG. 1 shows the core barrel assembly 10 before the commencement of the coring process. Drilling fluid is passed downwardly through the top adaptor 24 and passes via the swivel assembly 18 into the inner barrel 16 and the cavity between the inner barrel 16 and the outer barrel 14. Before the commencement of the coring process, a diverter ball 26 is dropped down into the swivel assembly to prevent drilling fluid passing into the inner barrel 16. The core sample 28 is then received within the inner barrel 16 as shown in FIG. 2 during a normal core sampling operation. FIG. 3 shows an example of the coring process in which the core sample 28 has collapsed. As can be seen, the collapsed core sample 28 fills the clearance left between the core sample 28 and the inner barrel 16 thereby creating friction.

Figure 4:
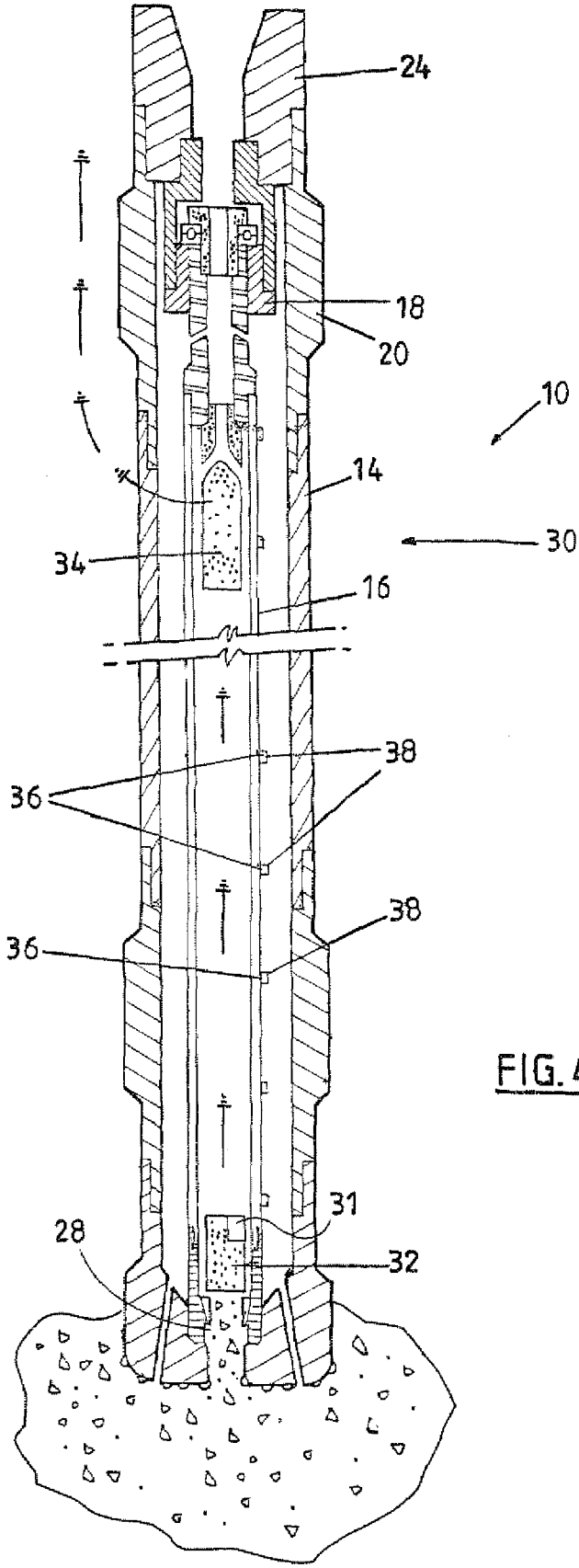
FIG. 4 is a side cross sectional view of a core barrel assembly having a core barrel capacity gauge in accordance with the present invention.

Referring to FIG. 4 there is shown a core sample capacity gauge 30 provided on a core barrel assembly 10 of the type shown in FIGS. 1 to 3. The core barrel capacity gauge 30 comprises a core sample marker 32 and a marker location sensor 34. The marker location sensor 34 is arranged to detect the location of the core sample marker 32 within the inner barrel 16.

In the embodiment shown, the core sample marker 32 comprises a housing having a magnetic field detection means and a signal generator. The magnetic field detection means comprises suitable electronics to determine the presence of a magnetic field of predetermined strength. The inner barrel 16 is provided with a plurality of position markers 36 at regular intervals along the length, each comprising a magnet 38.

The magnetic field detection means is arranged to detect the magnetic field generated by the magnets 38 as the core sample marker 32 passes the magnets 38. Upon detection of the magnet field of one of the magnets 38 by the magnetic field detection means, the signal generator produces a signal in the form of a percussion wave which is transmitted up the inner barrel 16 in the drilling fluid.

The marker location sensor 34 is provided within the inner barrel 16 adjacent the swivel assembly 18. The marker location sensor 34 detects the percussion wave generated by the core sample marker 32 and transmits, by a suitable means, a signal to a signal receiver (not shown) at the surface. The signal transmitted to the surface by the marker location sensor 34 may also be in the form of a percussion wave signal transmitted through the drilling fluid. The signal receiver at the surface includes a suitable means to indicate to the driller the location of the core sample marker 32 within the inner barrel 16 based on the signals received from the marker location sensor.

As the driller is then able to determine the position of the core sample marker 32 (and therefore the top of the core sample) with respect to the inner barrel 16, it is possible to determine any collapse of the core sample 28. That is, if the distance the distance the inner barrel 16 has passed the core sample marker 32 is significantly less than the distance drilled down, then the driller will know that some collapse of the core sample 28 has occurred.

The core barrel capacity gauge 30 may also be provided with a pressure sensor (in sensor assembly 31) and a temperature sensor (in sensor assembly 31) to provide information to the operator regarding the pressure of the drilling fluid and temperature within the core barrel assembly. Further a rotational sensor (in sensor assembly 31) may be provided to indicate to the operator whether the inner barrel 16 is rotating with outer barrel 14. The temperature, pressure and rotational information may be used by the operator to further assess the progress of the coring operation.

Modifications and variations as would be apparent to a skilled addressee are deemed to be within the scope of the present invention

The invention claimed is:

1. A core barrel capacity gauge for use on a core barrel assembly having a barrel for receiving a core sample, the core barrel capacity gauge comprising:

a core sample marker located within the barrel such that the core sample marker is adjacent a drilled core sample, the core sample marker including a signal generator that transmits a signal indicative of a position of the core sample marker relative to the barrel, and a marker location sensor including a receiver to receive the signal from the core sample marker.

2. A core barrel capacity gauge in accordance with claim 1, wherein the signal generator generates a percussion wave transmitted through drilling fluid in the barrel of the core barrel assembly.

3. A core barrel capacity gauge in accordance with claim 1, wherein the marker location sensor is located in the barrel adjacent the upper end thereof and includes a transmitter for transmitting information indicative of the position of the core sample marker to a receiver at the surface.

4. A core barrel capacity gauge in accordance with claim 3, wherein the receiver includes a display displaying information indicative of the position of the core sample marker within the barrel.

5. A core barrel capacity gauge in accordance with claim 1, further comprising a pressure sensor senses a pressure of the drilling fluid within the barrel of the core barrel assembly.

6. A core barrel capacity gauge in accordance with claim 1, further comprising a temperature sensor sensing a temperature within the barrel of the core barrel assembly.

7. A core barrel capacity gauge in accordance with claim 1, further comprising a rotational sensor sensing whether an inner barrel of the core barrel assembly is rotating with an outer barrel of the core barrel assembly.

8. A core barrel capacity gauge for use on a core barrel assembly having a barrel for receiving a core sample, the core barrel capacity gauge comprising:

a core sample marker located within the barrel such that the core sample marker rests against a top of a drilled core sample, and a marker location sensor arranged to detect a position of the core sample marker within the barrel, wherein the core sample marker includes a magnetic field sensor and the barrel includes a plurality of magnets along the length thereof, such that when the core sample marker passes one of said magnets, the magnetic field sensor detects the presence of that marker and generates said signal to be received by the marker location sensor.

9. A core barrel capacity gauge for use on a core barrel assembly having a barrel for receiving a core sample, the core barrel capacity gauge comprising:

a core sample marker in the barrel and adapted to rests against a top of a drilled core sample, the core sample marker including a signal generator that transmits a signal indicative of a position of the core sample marker relative to the barrel, and a marker location sensor including a receiver to receive the signal transmitted from the core sample marker.

10. A core barrel capacity gauge as in claim 9 wherein the core sample marker includes a position sensor and the barrel includes position markers arranged longitudinally along a length of the barrel.

11. A core barrel capacity gauge as in claim 9 wherein the core sample marker generates a percussion wave and the marker location sensor senses the wave.

12. A core barrel capacity gauge as in claim 9 wherein the marker location sensor is arranged in an upper portion of the barrel.

13. A core barrel capacity gauge for use on a core barrel assembly having a barrel for receiving a core sample, the core barrel capacity gauge comprising:

a core sample marker in the barrel and adapted to rest against a top of a drilled core sample, and a marker location sensor arranged to detect a position of the core sample marker within the barrel, wherein the position sensor includes a magnetic sensor and the position markers include magnets arranged at predetermined locations along a length of the barrel.

14. A method for detecting a position of a core sample within a core barrel assembly comprising:

receiving at least one core sample in a barrel of the assembly;

positioning a core sample marker in the barrel and on the at least one core sample in the barrel;

the core sample marker in the barrel detecting a position of the core sample marker relative to the barrel; and using the detected position of the core sample marker relative to the barrel to determine a condition of the at least one core sample.

15. A method as in claim 14 wherein the core sample is received during coring a geological formation with the core barrel assembly.

16. A method as in claim 15 wherein the condition of the at least one core sample is a core sample collapse in the barrel.

17. A method as in claim 15 further wherein the position of the core sample marker is sensed by a marker location sensor arranged in the barrel and the sensor transmits a signal indicative of at least one of a position of the at least one core sample and the condition of the at least one core sample.

18. A method as in claim 17 wherein the core sample marker produces a percussion wave in the barrel which is sensed by the marker location sensor, and the sensed percussion wave is used by the marker location sensor to generate the signal.

19. A method as in claim 14 wherein the core sample marker is positioned on an upper surface of an upper core sample of the at least one core sample in the barrel.

20. A core barrel capacity gauge for use on a core barrel assembly having a barrel for receiving a core sample, the core barrel capacity gauge comprising:

a core sample marker in the barrel and adjacent a drilled core sample;

markers arranged at intervals along a length of the barrel;

a signal generator included with the core sample marker that transmits a signal as the core sample marker moves past each of the markers, wherein the signal indicates that the core sample marker is aligned with one of the markers and a marker location sensor including a receiver to receive the signal from the core sample marker.

* * * * *